US007861828B1

(12) United States Patent
Shepard

(10) Patent No.: US 7,861,828 B1
(45) Date of Patent: Jan. 4, 2011

(54) VEHICLE STORAGE LIFT

(76) Inventor: James E. Shepard, 414 Henry St., Mukwonago, WI (US) 53149

( * ) Notice: Subject to any disclaimer, the term of this patent is extended or adjusted under 35 U.S.C. 154(b) by 478 days.

(21) Appl. No.: 11/854,716

(22) Filed: Sep. 13, 2007

(51) Int. Cl.
*B66F 7/06* (2006.01)
*B66F 7/28* (2006.01)

(52) U.S. Cl. ..... 187/211; 187/218; 187/220; 254/49

(58) Field of Classification Search ..... 187/211, 187/269, 218, 220; 254/46, 49; 414/229, 414/234; 211/192, 194, 195, 201, 202; *B66F 7/02, B66F 7/06, 7/22, 7/28*
See application file for complete search history.

(56) References Cited

U.S. PATENT DOCUMENTS

| | | | | |
|---|---|---|---|---|
| 711,098 | A | 10/1902 | Carr | |
| 2,497,472 | A * | 2/1950 | Sims | 187/211 |
| 3,306,579 | A | 2/1967 | Campbell | |
| 3,902,613 | A | 9/1975 | Newland | |
| 4,068,772 | A * | 1/1978 | Prudhomme | 414/477 |
| 4,469,346 | A * | 9/1984 | Low | 280/414.1 |
| 4,784,545 | A * | 11/1988 | Lawrence | 410/26 |
| 4,954,038 | A | 9/1990 | Sheahan | |
| 4,958,804 | A | 9/1990 | Lenius et al. | |
| 5,016,893 | A * | 5/1991 | Hart, Jr. | 280/35 |
| 5,468,115 | A * | 11/1995 | Alvis | 414/556 |
| 5,772,388 | A * | 6/1998 | Clark | 414/484 |
| 6,003,841 | A | 12/1999 | Aisenbrey et al. | |
| 6,474,626 | B1 | 11/2002 | Box | |
| 6,676,233 | B1 | 1/2004 | Evans et al. | |
| 6,705,820 | B2 | 3/2004 | Schilling | |
| 2002/0164233 | A1 * | 11/2002 | Payne | 414/234 |

FOREIGN PATENT DOCUMENTS

GB 2191758 A * 12/1987

* cited by examiner

*Primary Examiner*—Michael R Mansen
*Assistant Examiner*—Stefan Kruer
(74) *Attorney, Agent, or Firm*—Quarles & Brady LLP

(57) ABSTRACT

A vehicle storage lift includes a base frame having a first floor engaging leg parallel to a second floor engaging leg. A vehicle support supported by the base frame is movable between a load position and a store position. First and second support arms connect the vehicle support to the base frame. Each of the first support arms are connected at one end to the first leg and at an opposing end to the vehicle support. Each of the second support arms are connected at one end to the second leg and at an opposing end to the second frame member.

8 Claims, 9 Drawing Sheets

VEHICLE STORAGE LIFT

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

Recreational and work vehicles, such as snowmobiles and all terrain vehicles (ATVs) take up a significant amount of space when not in use. Lifts are available that can raise one vehicle above the floor allowing a second vehicle to be stored underneath the first vehicle. The known lifts are typically expensive and must be rigidly attached to a building structure. A need exists for an improved lift that can be portable and provides space for storage beneath a lifted and stored first vehicle.

BRIEF SUMMARY OF THE INVENTION

The present invention provides a vehicle storage lift that can be portable and provide space for storage of a second vehicle beneath a raised first vehicle. The vehicle lift includes a base frame including a first floor engaging leg parallel to a second floor engaging leg. A vehicle support supported by the base frame is movable between a load position and a store position. First and second support arms connect the vehicle support to the base frame. Each of the first support arms are connected at one end to the first leg and at an opposing end to the vehicle support. Each of the second support arms are connected at one end to the second leg and at an opposing end to the second frame member.

A general objective of the present invention is to provide vehicle lift that can be portable and provides space for storage beneath a lifted and stored first vehicle. This objective is accomplished by providing the lift with a base frame having spaced parallel legs. In one embodiment, the base frame supports the vertically movable vehicle support without the need to secure the lift to a permanent structure.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
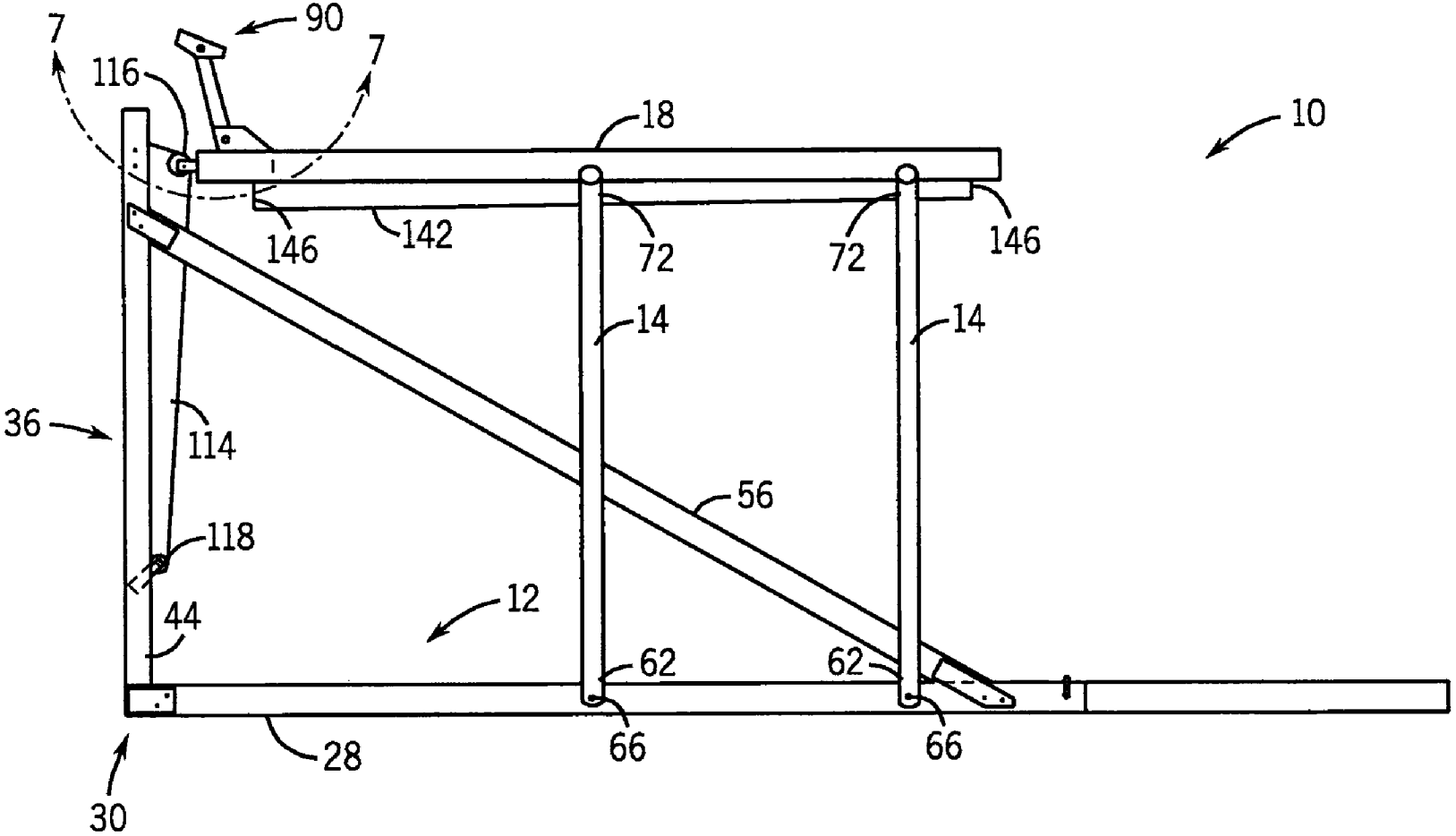
FIG. 1 is a side elevation view of a vehicle lift in a store position and incorporating the present invention.

A vehicle storage lift 10 incorporating the present invention is shown in FIGS. 1-5, and includes a ground supported base frame 12 having pivotably fixed support arms 14 supporting a vertically movable vehicle support 18. The lift 10 vertically moves the vehicle support 18 having a first vehicle 22 thereon from a load position to a store position to provide a storage space for a second vehicle 24 beneath the first vehicle 22.

The ground supported base frame 12 includes a pair of horizontal parallel ground engaging legs 28 joined at a head end 30 by a cross bar 32. The legs 28 are laterally spaced a distance sufficient to allow the second vehicle 24 therebetween. Preferably, the legs 28 and other frame members are formed from tube steel to provide sufficient structural rigidity. Legs 28 formed from other structural members, such as angle iron, channels, and the like can be used without departing from the scope of the invention.

A hoist support frame 36 extending vertically upwardly from the head end 30 of the base frame 12 supports a hoist 42 that moves the vehicle support 18 between the load position and the store position. The hoist support frame 36 is rigidly fixed to the head end 30 of the base frame 12, using methods known in the art, such as welding, bolting and the like. In a preferred embodiment, the hoist support frame 36 includes a pair of upwardly extending parallel legs 44 joined by an intermediate cross bar 46 and a top bar 52. A stiffening bar 50 extending between the hoist support frame 36 can be provided above the top bar 52 to further stiffen the hoist support frame, if desired.

A pair of braces 56, each extending between a base frame leg 28 and adjacent hoist support frame leg 44 rigidly holds the hoist support frame 36 in the vertical position. Preferably, each end of the braces 56 are rigidly attached to a respective base frame leg 28 and hoist support frame leg 44 using brackets 58 welded to the brace 56 and bolted to the respective base frame leg 28 and hoist support frame leg 44 to simplify assembly. Of course, other methods for attaching the braces to the base frame 12 and hoist support frame 36 can be used, such as welding the braces directly to the respective base frame leg and hoist support frame leg, without departing from the scope of the invention. In an alternate embodiment, the braces 56 can be eliminated by securing the hoist support frame 36 to a wall or other structure.

A pair of the lift support arms 14 are pivotably fixed to each base frame leg 28 and support the vertically movable vehicle support 18. Preferably lower ends 62 of the lift support arms 14 are pivotably fixed to laterally outwardly facing surfaces 64 of the base frame legs 28 to provide a maximum unobstructed lateral width between the parallel base frame legs 28 for receiving a vehicle therebetween. Most preferably, a pin 66 extending through each lower end 62 of each lift support arm 14 and the adjacent base frame leg 28 pivotally fixes the lift support arm 14 relative to the adjacent base frame leg 28.

Figure 6:
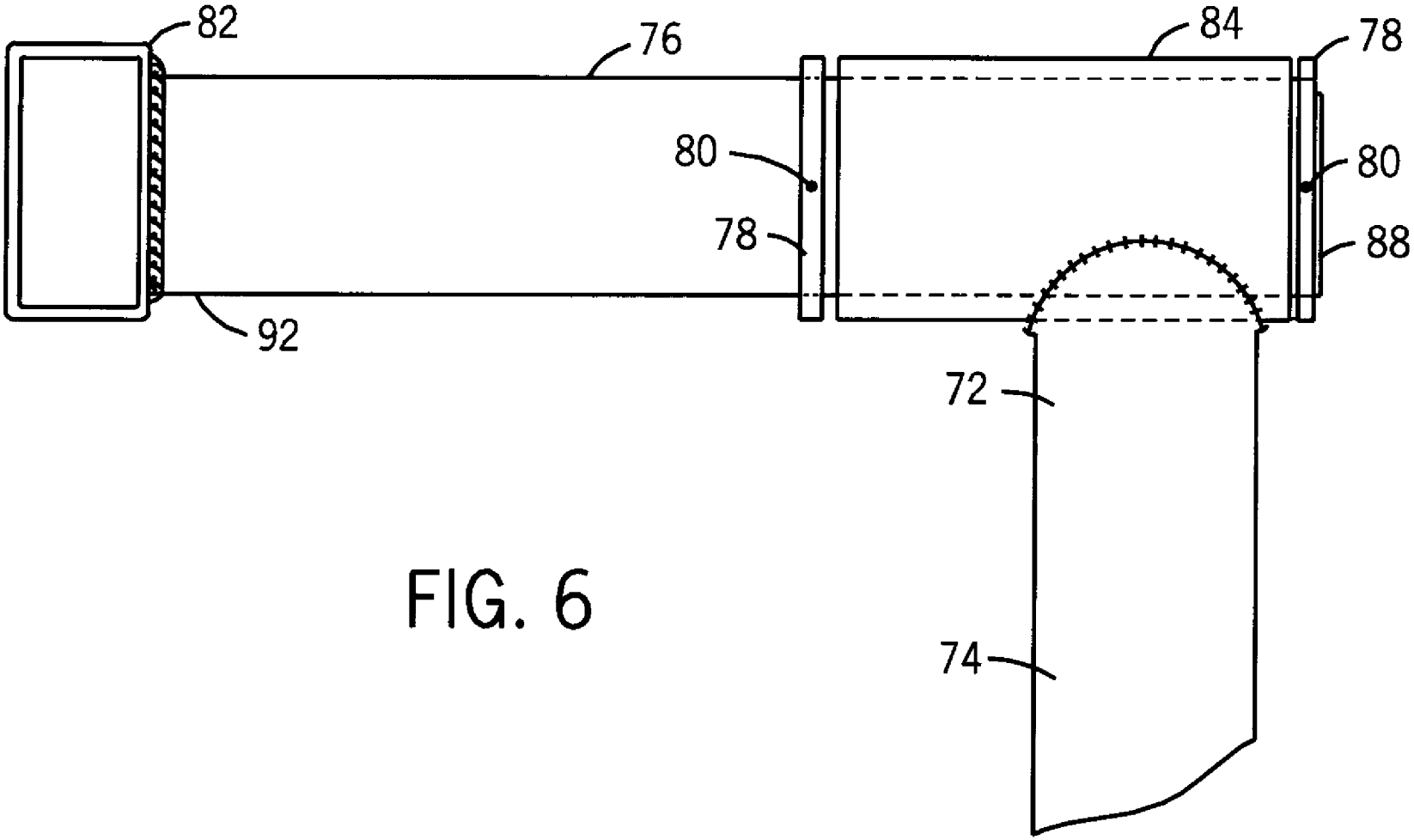
FIG. 6 is a detailed view along line 6-6 of FIG. 2.

Upper ends 72 of each lift support arm 14 pivotally support the vertically movable vehicle support 18 to maintain the vehicle support 18 relatively horizontal as the vehicle support 18 moves between the load position and the store position. Preferably, as shown in FIG. 6, the upper end 72 of each lift support arm 14 is pivotally attached to the vehicle support 18 by an elongated cylindrical bushing 74 fixed to the upper end 72 of the lift support arm 14. Each bushing 74 receives a laterally extending cylindrical bar 76 forming part of the vehicle support 18. Collars 78 retained by a set screws 80 impinging on the cylindrical bar 76 can be provided on opposing axial sides of the bushing 74 to inhibit axial movement of the cylindrical bar 76 extending through the bushing 74.

Figure 2:
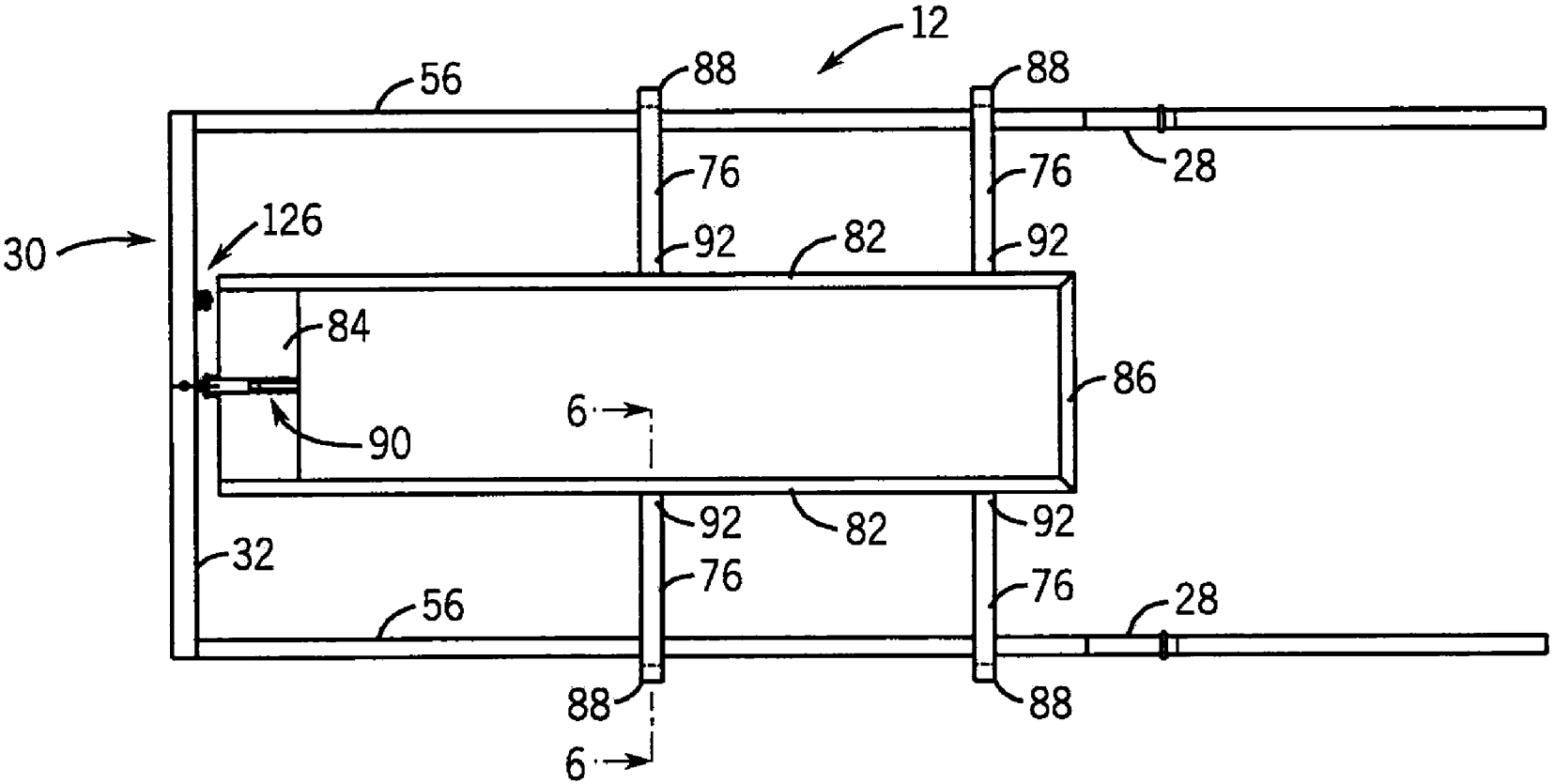
FIG. 2 is a top plan view of the lift of FIG. 1 with the snowmobile rear support not shown.
Figure 3:
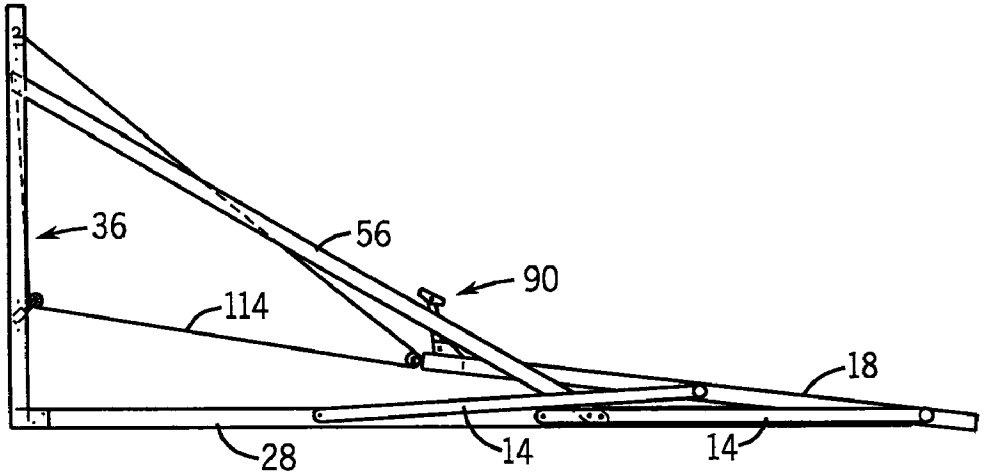
FIG. 3 is a side elevation view of the vehicle lift of FIG. 1 in a load position.
Figure 4:
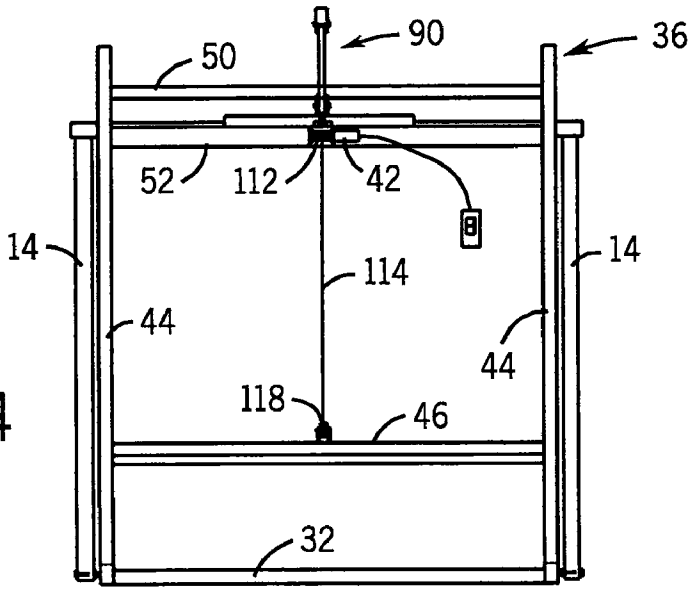
FIG. 4 is a rear elevation view of the vehicle lift of FIG. 3 with the snowmobile rear support not shown.

Referring now to FIGS. 1 and 2, the vertically movable vehicle support 18 supports a vehicle above the base frame 12, and thus the floor in the stored position. Preferably, the vehicle support 18 is a rectangular frame including a pair of parallel side frame members 82 joined by parallel head and foot frame members 84, 86. Two opposing pairs of the laterally extending cylindrical bars 76 having laterally outer ends 88 extend through the bushings 74. Laterally inner ends 92 of each cylindrical bar 76 are rigidly fixed to the side frame members 82. Although a vehicle support 18 defining a rectangular frame is preferred for storing a snowmobile, the vehicle support 18 can be a platform defining a planar surface with or without integral frame members without departing the scope of the invention.

Figure 5:
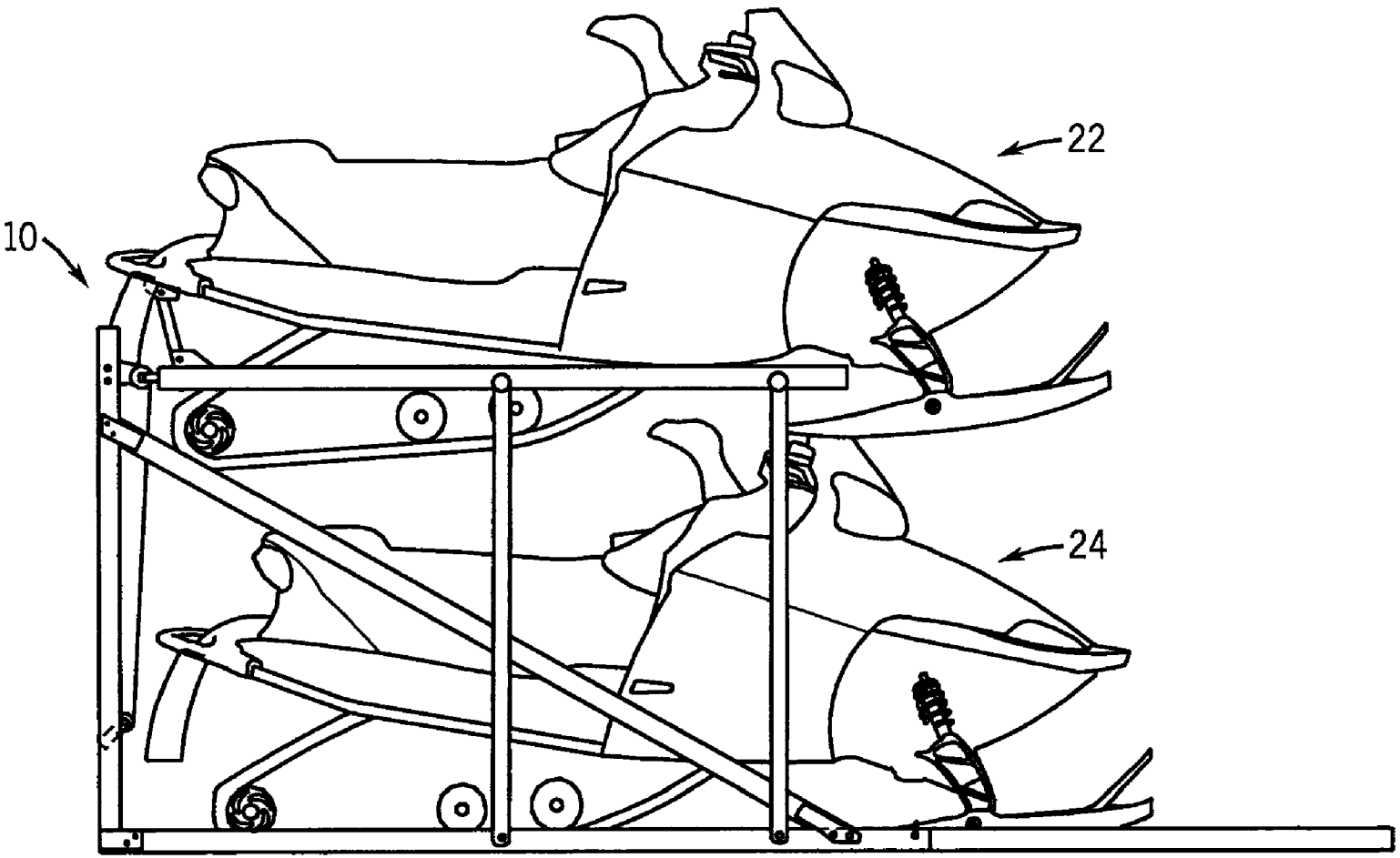
FIG. 5 is a side elevation view of the vehicle lift of FIG. 1 with a first vehicle stored thereon and a second vehicle disposed beneath the first vehicle.

In a preferred embodiment especially suitable for snowmobile storage, the rectangular frame of the vehicle support 18 is open allowing the track of a snowmobile to hang loose beneath the snowmobile, as shown in FIG. 5. In order to allow the snowmobile track to hang loose without limiting the height of the second vehicle shown below, a snowmobile rear support 90 is mounted to the vehicle support 18 to support a rear end of the snowmobile above the vehicle support 18. Preferably, the snowmobile rear support 90 can be folded over to allow the vehicle support 18 to support other types of vehicle, such as an ATV.

Figure 7:
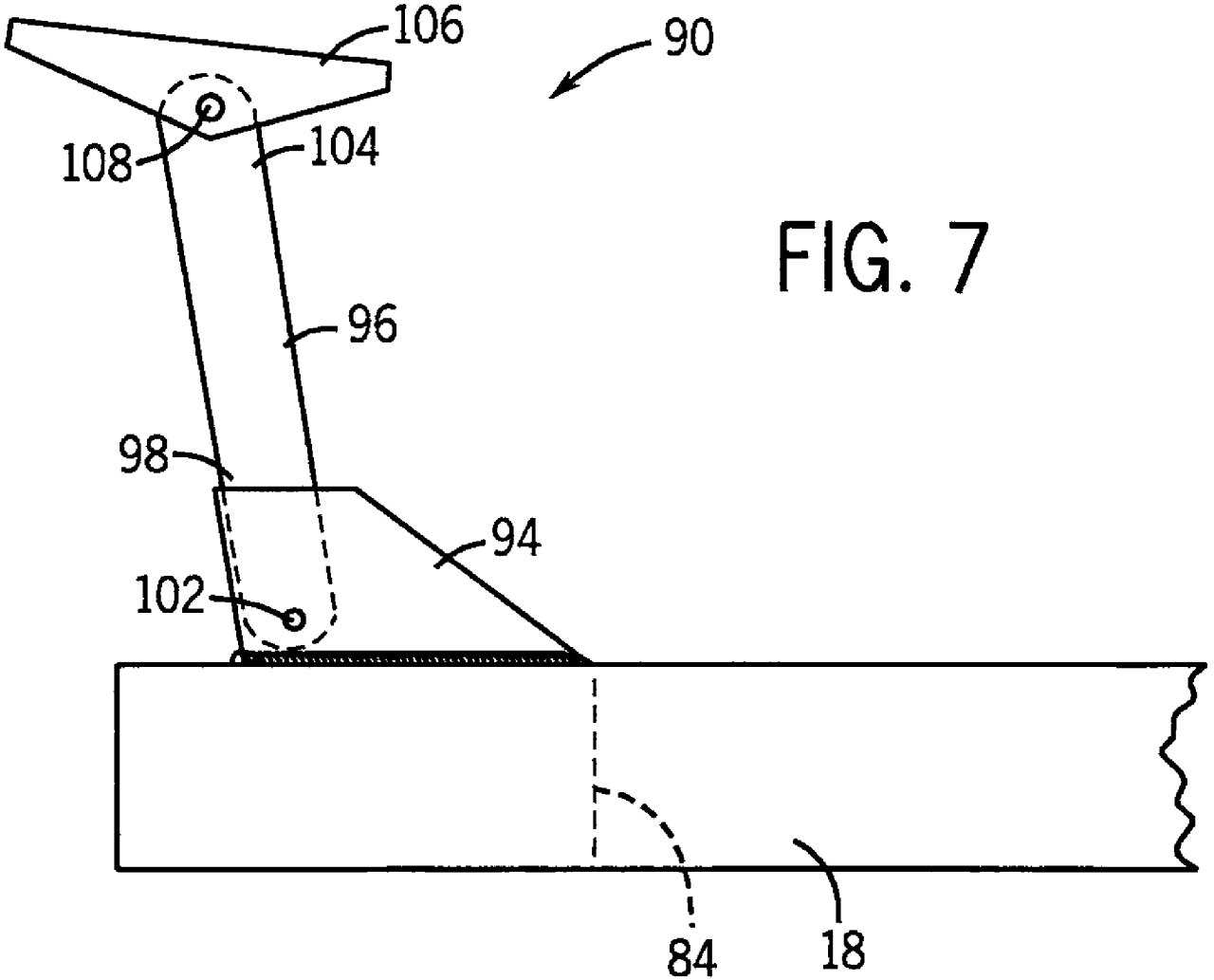
FIG. 7 is a detailed view along line 7-7 of the snowmobile rear support FIG. 1 in an extended position.
Figure 8:
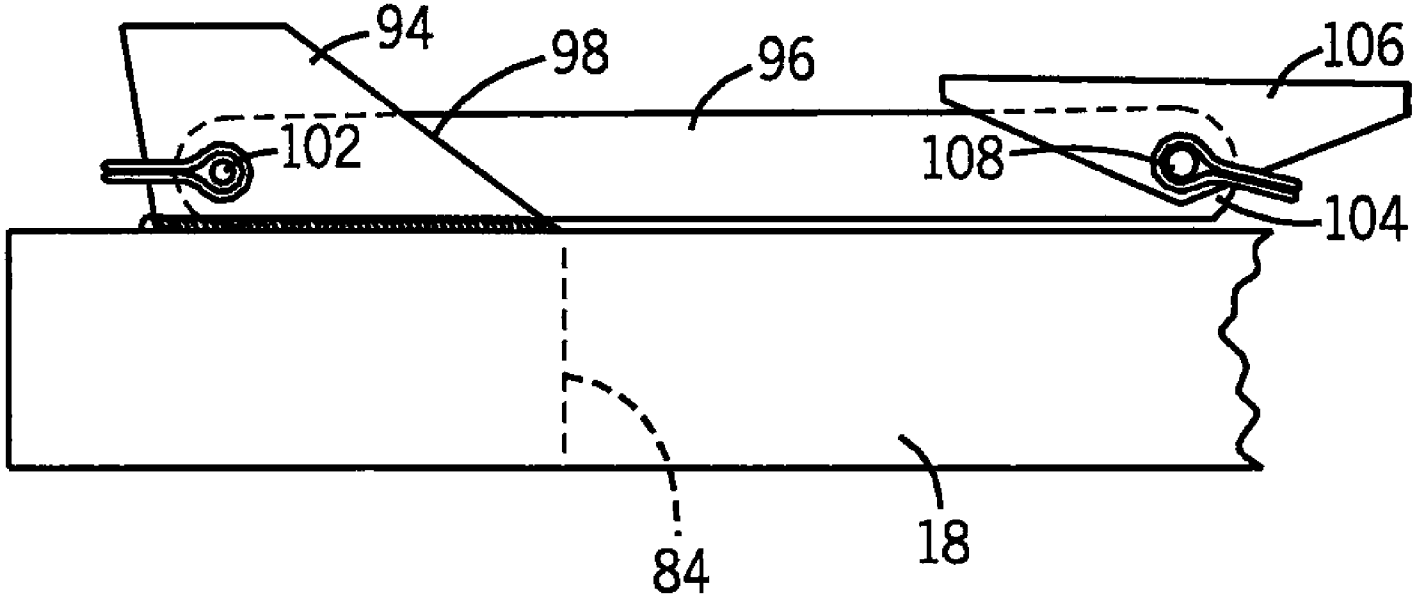
FIG. 8 is a view of the snowmobile rear support of FIG. 7 in a folded position.

As shown in FIGS. 1, 7 and 8, preferably, the snowmobile rear support 90 includes a bracket 94 fixed to the rectangular frame head member 84. A support arm 96 having a proximal end 98 pivotally fixed to the bracket 94 by a pin 102. A distal end 104 of the support arm includes an engagement bracket 106 pivotally fixed thereto by another pin 108. The support arm is pivotably movable between an extended position (shown in FIG. 7) and a folded position (shown in FIG. 8). In the extended position, the engagement bracket 106 engages the rear end of the snowmobile to support the snowmobile rear end above the vehicle support 18.

In the embodiment shown in FIGS. 1-5, the vehicle support 18 is vertically moved between the load position and the store position by the electric hoist 42 attached to the hoist support frame top bar 52. The hoist 42 winds and unwinds a cable 114 passing through a first sheave 116 fixed to and supported by the rectangular frame head member 84 and a second sheave 118 fixed to and supported by the hoist support frame cross bar 46. The hoist 42 includes a hoist spool 112 and one end of the cable 114 fixed thereto. A free end of the cable 114 is anchored to the hoist support top bar 52. As a result, the vehicle support 18 is lowered to the load position as the hoist 42 unwinds the cable 114 from the hoist spool. Likewise, the vehicle support 18 is raised to the store position as the hoist 42 winds, or retracts, the cable 114 onto the hoist spool. Although moving the vehicle support 18 between the load position and store position using a hoist 42 is preferred, other methods of moving the vehicle support, such as hydraulically, pneumatically, manually, and the like, can be used without departing from the scope of the invention.

Figure 9:
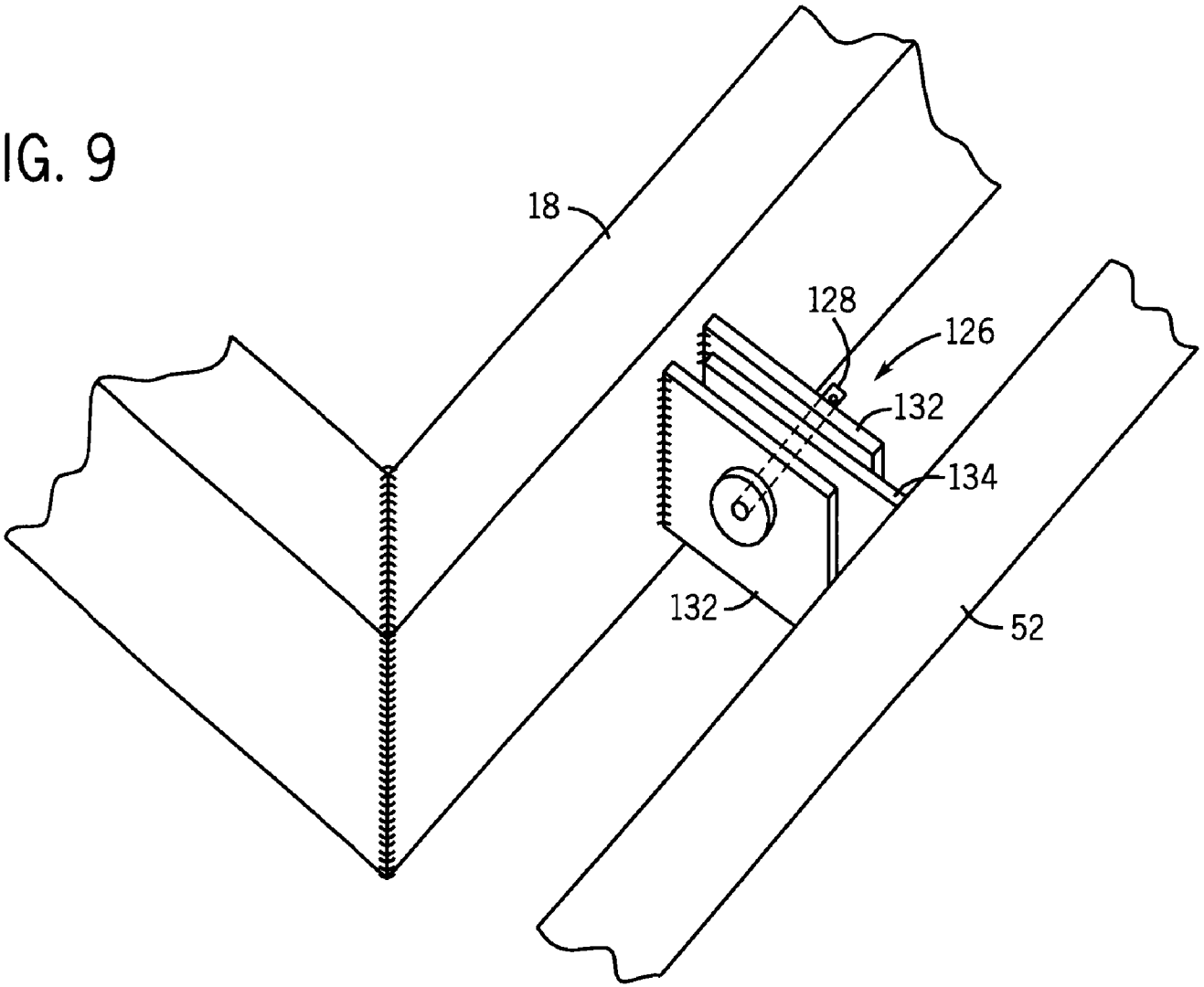
FIG. 9 is a perspective view of the lock of FIG. 1.
Figure 10:
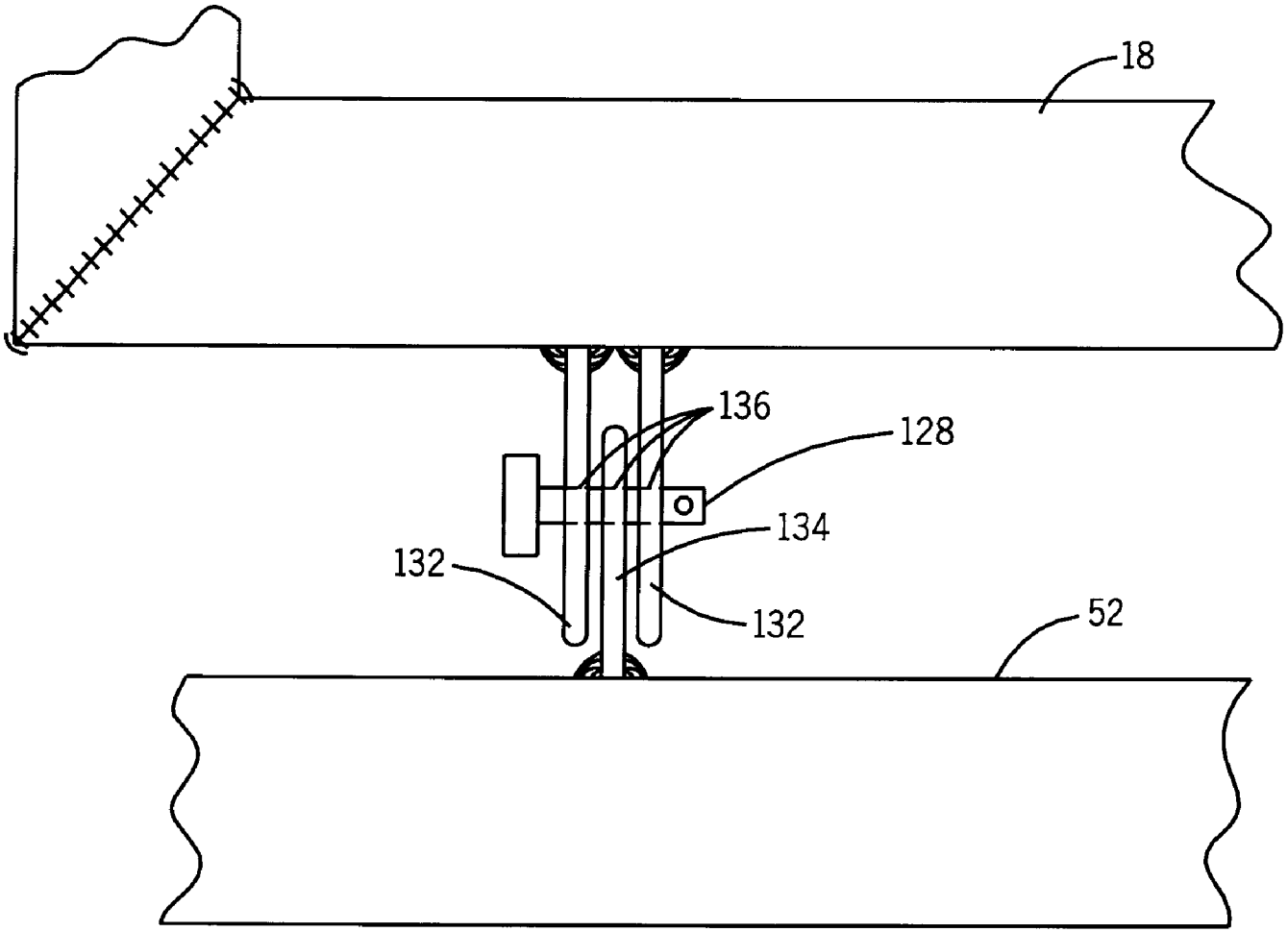
FIG. 10 is a top view of the lock of FIG. 9.

Preferably, the vehicle support 18 is secured in the store position by a lock 126. In the embodiment shown in FIGS. 2, 9, and 10, the lock 126 includes a pin 128 extending through interdigitating plates 132, 134 to prevent the vehicle support 18 from unintentionally moving from the store position. A pair of first plates 132 extend from the hoist support frame top bar 52 toward the vehicle support 18 in the vehicle support store position. A second plate 134 extending from the vehicle support 18 is received between the first plates 132 in the vehicle support store position. The pin 128 extends though aligned apertures 136 formed through the first and second plates 132, 134 to lock the second plate 134 relative to the first plates 132 and prevent the vehicle support 18 from unintentionally moving from the store position.

As shown in FIG. 1, a drip pan 142 suspended beneath the vehicle support 18 can be provided to catch any liquid runoff, such as melting snow or ice, oil, fuel, and the like, from the first vehicle 22 supported by the vehicle support 18 and prevent the liquid runoff from dripping on the second vehicle 24 stored beneath the first vehicle 22. Preferably, the drip pan 142 is pitched toward the hoist support frame 36 or one of the base frame legs 28 to prevent the liquid runoff from dripping onto the second vehicle 24 as the second vehicle 24 is moved underneath the first vehicle 22. Most preferably, the drip pan 142 is removably suspended by chains or brackets attached to the vehicle support 18 to facilitate cleaning the drip pan 142 after extended use.

In use, referring to FIGS. 1-5, the vehicle support 18 is lowered to the load position by unwinding the cable 114 from the hoist 42. In the load position, the vehicle support 18 remains substantially horizontal and is lowered between the base frame legs 28. Once in the load position, a vehicle is placed onto the vehicle support 18, such as driving the vehicle over the vehicle support 18 between the base frame legs 28. If the vehicle is a snowmobile, the snowmobile rear support 90 is moved to an extended position beneath the rear of the snowmobile to support the rear end of the snowmobile.

The vehicle support 18 is raised to the store position by retracting the hoist cable 114. The retracting cable 114 exerts a force on the vehicle support 18 causing the lift support arms 14 to pivot and raise the vehicle support 18 to the store position and form a space for storing the second vehicle 24 beneath the vehicle support 18 and between the base frame legs 28. Once the vehicle support 18 is in the store position, the vehicle support 18 is secured in the store position by the lock.

While there have been shown and described what is at present considered the preferred embodiments of the invention, it will be obvious to those skilled in the art that various changes and modifications can be made therein without departing from the scope of the invention defined by the appended claims.

I claim:

1. A vehicle lift for a snowmobile having a track extending from the snowmobile, the vehicle lift comprising:

a base frame including a first floor engaging leg parallel to a second floor engaging leg;

a vehicle support movable between a load position and a store position, said vehicle support being interposed between said first and second legs and having a first frame member and a second frame member, said first and second frame members being substantially parallel to said legs;

a pair of first support arms, each of said first support arms being connected at one end to said first leg and at an opposing end to said first frame member;

a pair of second support arms, each of said second support arms being connected at one end to said second leg and at an opposing end to said second frame member, wherein in said store position, said vehicle support is supported by said first and second support arms above a space capable of storing a vehicle beneath said vehicle support and between said base frame legs; and a rear support upwardly extendable from the vehicle support in both the load position and the store position and including a support arm pivotally attached to the vehicle support on one end of the support arm and pivotally attached to an engagement head on the other end of the support arm; and wherein the engagement head engages the rear end of the snowmobile to support the snowmobile rear end above the vehicle support and the track hangs below the vehicle support when the vehicle support is in the store position.

2. The vehicle lift as in claim 1, including a vertical support frame extending upwardly from one end of said base frame, said vertical support frame supporting means for moving said vehicle support between said store position and said load position.

3. The vehicle lift as in claim 1, in which said vehicle support includes cross members joining said first and second frame members and defining an opening through which the track of the snowmobile supported by said vehicle support can hang.

4. The vehicle lift as in claim 1, in which said rear support is movable between an upwardly extended position and a folded position.

5. The vehicle lift as in claim 1, including a drip pan disposed beneath said vehicle support and above said base frame for collecting liquid dripping from a vehicle supported by said vehicle support.

6. The vehicle lift as in claim 1, in which said vehicle support is secured in said store position by a lock.

7. The vehicle lift as in claim 5, in which said pan is pitched toward at least one of said base legs.

8. The vehicle lift as in claim 1, in which said rear support is not a loading ramp.

* * * * *